US010464726B2

(12) United States Patent
Rognard

(10) Patent No.: US 10,464,726 B2
(45) Date of Patent: Nov. 5, 2019

(54) TAMPER-EVIDENT CLOSURE

(71) Applicant: Obrist Closures Switzerland GmbH, Reinach (CH)

(72) Inventor: Jean-Yves Rognard, Marcy-sur-Anse (FR)

(73) Assignee: Obrist Closures Switzerland GmbH, Reinach (CH)

( * ) Notice: Subject to any disclaimer, the term of this patent is extended or adjusted under 35 U.S.C. 154(b) by 136 days.

(21) Appl. No.: 15/579,018

(22) PCT Filed: May 28, 2016

(86) PCT No.: PCT/EP2016/062096

§ 371 (c)(1),
(2) Date: Dec. 1, 2017

(87) PCT Pub. No.: WO2016/193183

PCT Pub. Date: Dec. 8, 2016

(65) Prior Publication Data

US 2018/0141730 A1 May 24, 2018

(30) Foreign Application Priority Data

Jun. 1, 2015 (GB) ..... 1509400.6

(51) Int. Cl.
*B65D 55/02* (2006.01)
*B65D 41/34* (2006.01)
*B65D 1/02* (2006.01)

(52) U.S. Cl.
CPC ..... *B65D 55/024* (2013.01); *B65D 1/0246* (2013.01); *B65D 41/34* (2013.01);
(Continued)

(58) Field of Classification Search
CPC .... B65D 55/024; B65D 55/02; B65D 1/0246; B65D 1/023; B65D 1/0238; B65D 1/0223;
(Continued)

(56) References Cited

U.S. PATENT DOCUMENTS 2,961,119 A * 11/1960 Leach ..... B65D 41/0414 215/243
3,272,405 A * 9/1966 Todd ..... B65D 47/061 222/525
(Continued)

FOREIGN PATENT DOCUMENTS

EP 0541466 A1 5/1993
JP 2006151407 A 6/2006
(Continued)

OTHER PUBLICATIONS

Aug. 22, 2016—(WO) International Search Report and Written Opinion—App PCT/EP2016/062096.
Jun. 23, 2015—(GB) Search Report—App 1509400.6.

*Primary Examiner* — Robert J Hicks
(74) *Attorney, Agent, or Firm* — Banner & Witcoff, Ltd.

(57) ABSTRACT

A tamper-evident closure is provided and comprises a body and a separate plug member. The body has a sidewall including screw thread formations for screwing the closure onto a screw threaded container neck and the plug member is locatable on the neck to seal it. The closure comprises a tamper-evident member at least part of which is movable from a first position to a second position when the closure is unscrewed from the neck for the first time and, in use, when the body is unscrewed the body moves axially with respect to the plug member to cause the tamper-evident member to move from the first to the second position.

20 Claims, 7 Drawing Sheets

(52) U.S. Cl.
CPC .... *B65D 41/3442* (2013.01); *B65D 2101/003* (2013.01); *B65D 2101/0023* (2013.01); *B65D 2101/0069* (2013.01)

(58) Field of Classification Search
CPC .... B65D 47/36; B65D 41/3442; B65D 41/34; B65D 41/3428; B65D 41/0485
USPC ..... 215/341, 343, 346, 344, 253, 252, 251, 215/250, 364, 360, 358, 356, 355, 44, 43; 220/268, 266, 265, 802, 801, 796
See application file for complete search history.

(56) References Cited

U.S. PATENT DOCUMENTS

| | | | | |
|---|---|---|---|---|
| 3,393,823 | A * | 7/1968 | Dearing | B65D 39/084 220/214 |
| 6,681,946 | B1 * | 1/2004 | Jansen | A61J 1/1406 141/329 |
| 2015/0203261 | A1 * | 7/2015 | Lee | B65D 51/285 206/219 |

FOREIGN PATENT DOCUMENTS

| | | | |
|---|---|---|---|
| WO | 2009022892 | A1 | 2/2009 |
| WO | 2014082863 | A1 | 6/2014 |
| WO | 2015049066 | A1 | 4/2015 |
| WO | 2015121177 | A1 | 8/2015 |

* cited by examiner

Figure 11
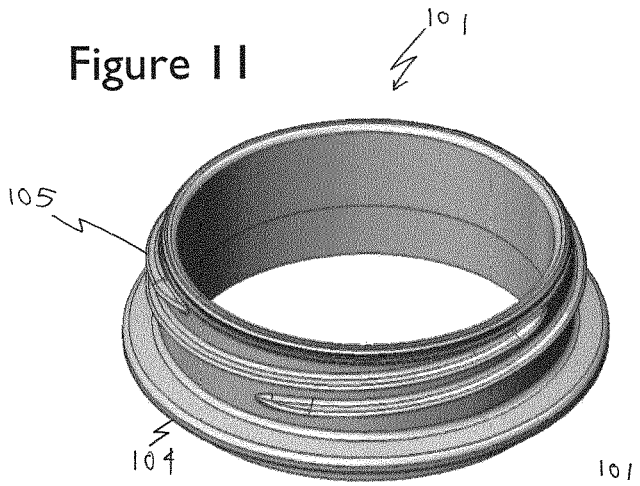
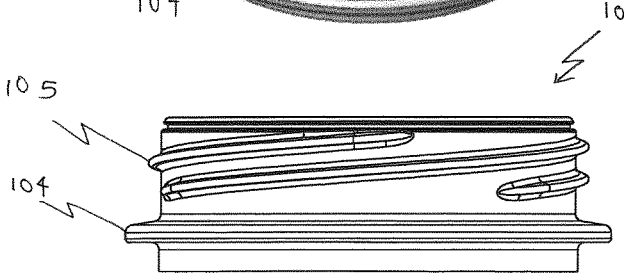
Figure 12
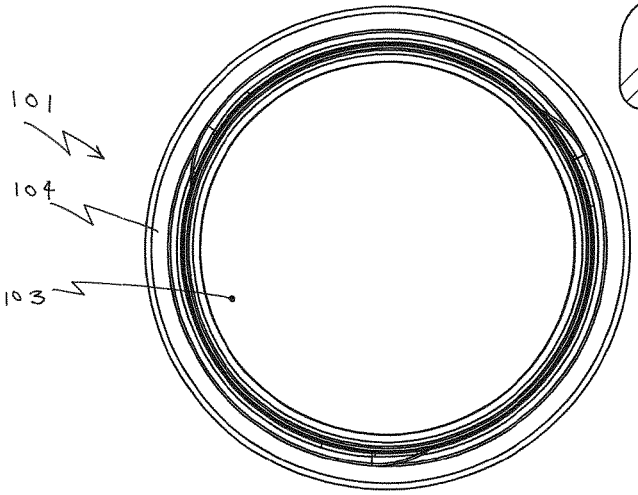
Figure 13
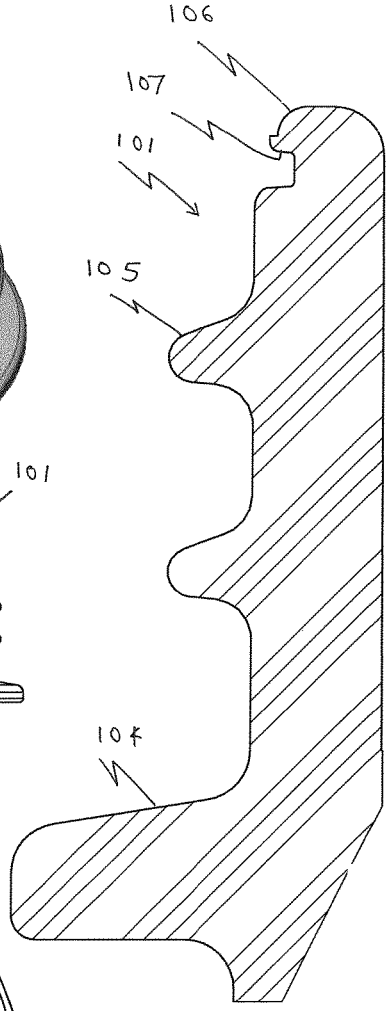
Figure 14

TAMPER-EVIDENT CLOSURE

CROSS-REFERENCE TO RELATED APPLICATIONS

The present application is a U.S. National Phase of International Application No. PCT/EP2016/062096, filed on May 28, 2016, designating the United States of America, and claims priority to British Patent Application No. 1509400.6, filed Jun. 1, 2015. This application claims priority to and the benefit of the above-identified applications, each of which is fully incorporated by reference herein.

The present invention relates generally to a closure and particularly, although not exclusively, to a container closure including one or more tamper-indicating features.

There is a widespread requirement within the field of closures for mechanisms which can be used to indicate to a consumer if a closure is unopened. One very common system uses a drop band which is frangibly connected to the open end of a closure and which drops onto and remains on a container neck if the closure is removed.

The present invention seeks to provide improvements over known tamper-indicating closures.

The present invention provides a tamper-evident closure comprising a body and a separate plug member, the body having a sidewall including screw thread formations for screwing the closure onto a screw threaded container neck and the plug member being locatable on the neck to seal it, the closure comprising a tamper-evident member at least part of which is movable from a first position to a second position when the closure is unscrewed from the neck for the first time, in use when the body is unscrewed the body moves axially with respect to the plug member to cause the tamper-evident member to move from the first to the second position.

The tamper-evident member may be non-frangibly associated with the body or the plug member.

The closure may comprise a tamper-evident drop band irreversibly moved from a first position to a second position to indicate if the closure has been opened, the closure comprising retention means for non-frangibly holding the band in the first position in an initial closed position, and as the closure is moved towards an open position the band is released from the retention means and moves to the second position.

The tamper-evident member may comprise two or more parts frangibly connected together which are separated when the body is unscrewed.

The tamper-evident member may comprise a tamper-evident band, for example a tamper-evident drop band.

The body may cause the band to be released from the plug as it moves away from an initial closed position.

The band may be generally annular.

The band may be of a unitary structure, for example a one-piece moulding.

The band may comprise one or more flaps for non-frangibly engaging the plug retention means.

The plug retention means may comprise an annular bead.

The band may be located in the interior of the closure.

The retention means may help to prevent the band from returning to the first position.

The body may include a window in which or through which the band is visible in the first position and out of which the band falls as it moves to the second position.

The present invention also provides a tamper-evident closure comprising a one-piece body and a separate plug member, the body having a sidewall including screw thread formations for screwing the closure onto a screw threaded container neck and the plug member being locatable on the neck to seal it, the closure comprising a tamper-evident member, the member comprising two parts frangibly connected together, one of the tamper-evident member parts is retained by the body and the other part is retained by the plug member, in use when the body is unscrewed for the first time the body moves axially with respect to the plug member to cause the tamper-evident parts to be separated.

The present invention also provides a tamper-evident plastics flat cap comprising a body and a tamper-evident member provided internally of the body for indicating if the cap has been removed from a container neck.

The body may include a surface formation for engaging the plug member as the body is unscrewed to lift the plug member off the neck.

The formation may be axially spaced from the plug member in the initially closed position so that lifting of the plug member is delayed until after the body has moved axially with respect thereto so as to cause separation of the dispensing member parts.

The plug member may comprise retention means for retaining it on the container neck.

The plug member retention means may be overcome by the body surface formation to lift the dispensing member off the neck.

The tamper-evident member may comprise two rings frangibly connected together.

After first opening one of the tamper-evident member parts may remain in the body and the other may drop onto the plug member.

The body may comprise a top plate. The top plate may be generally circular and the sidewall may be generally cylindrical and depend from the periphery of the top plate.

The top plate may be generally flat, for example generally disc-shape.

In one embodiment there are important interactions between:

1. a bead on a plug and a bead on a lower part of a tamper-evident double ring, which causes the ring to break if the lid is opened or if the base is removed;

2. a bead/clip on a plug which holds it onto a container neck (until a bead on the base lifts it off); and 3. a bead on the base and part (e.g. an edge) of the plug, which cause the plug to be lifted off the neck after the tamper-evident ring has been broken due to interaction 1.

In some embodiments the member is the only tamper-indicating feature; in other embodiments further features may be provided.

Closures of the present invention may be formed from any suitable material, such as a plastics material (for example PP or PE). The closure may be formed by moulding, for example by injection or compression moulding.

The present invention also provides a closure as described herein in combination with a container.

A further aspect provides a neck or neck finish for a container, the finish having a height in the range 7 mm to 11 mm when measured from a transfer bead. The finish may have a height in the range 8 to 10 mm, for example in the range 8 mm to 9 mm. In some embodiments the finish has a height of approximately 8.41 mm.

A further aspect provides a neck or neck finish for a tamper-evident closure, the neck finish being formed with an absence of a tamper-evident bead. The neck finish may be formed in combination with a closure having a base and be part of a system that can still detect an attempt to remove the base and provide an indication that the base has been removed.

The neck finish of aspects and embodiments of the present invention may be a 29/25 finish.

Finishes of the present invention may include engagement means for enabling connection to a closure, for example they may include an external and/or internal screw thread formation, snap bead or the like.

A further aspect provides a container having a neck or neck finish as described herein.

The present invention also provides for a closure as described herein in combination with a neck, neck finish or container as described herein.

The container, neck or neck finish of the present invention may be formed from any suitable material, including plastics material (e.g. PET, PP or PE) or glass.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which:

FIGS. 11 to 14 show perspective, side, plan and perspective views of a container neck finish for use with the closure of FIGS. 1 to 10.

Figure 2:
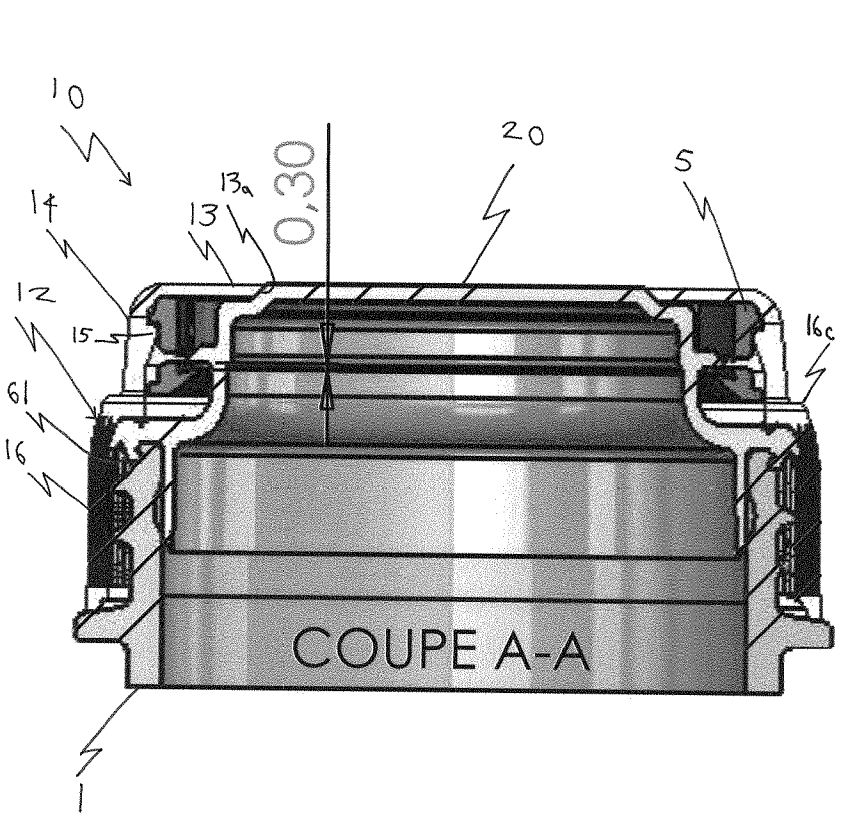
FIG. 2 is a section of the closure of FIG. 1 taken along line A-A.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Referring now to the drawings, wherein like reference numbers are used to designate like elements throughout the various views, several embodiments of the present invention are further described. The figures are not necessary drawn to scale, and in some instances the drawings may have been exaggerated or simplified for illustrative purposes only. One of ordinary skill in the art will appreciate the many possible applications and variations of the present invention based on the following examples of possible embodiments of the present invention.

Figure 1:
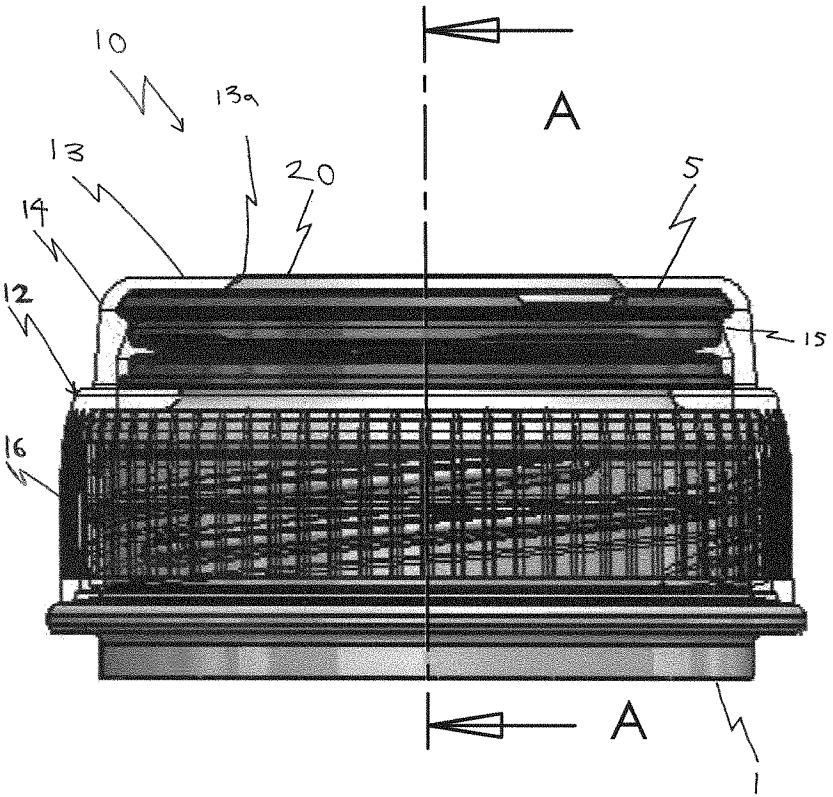
FIG. 1 is a side view of a closure formed according to the present invention.
Figure 3:
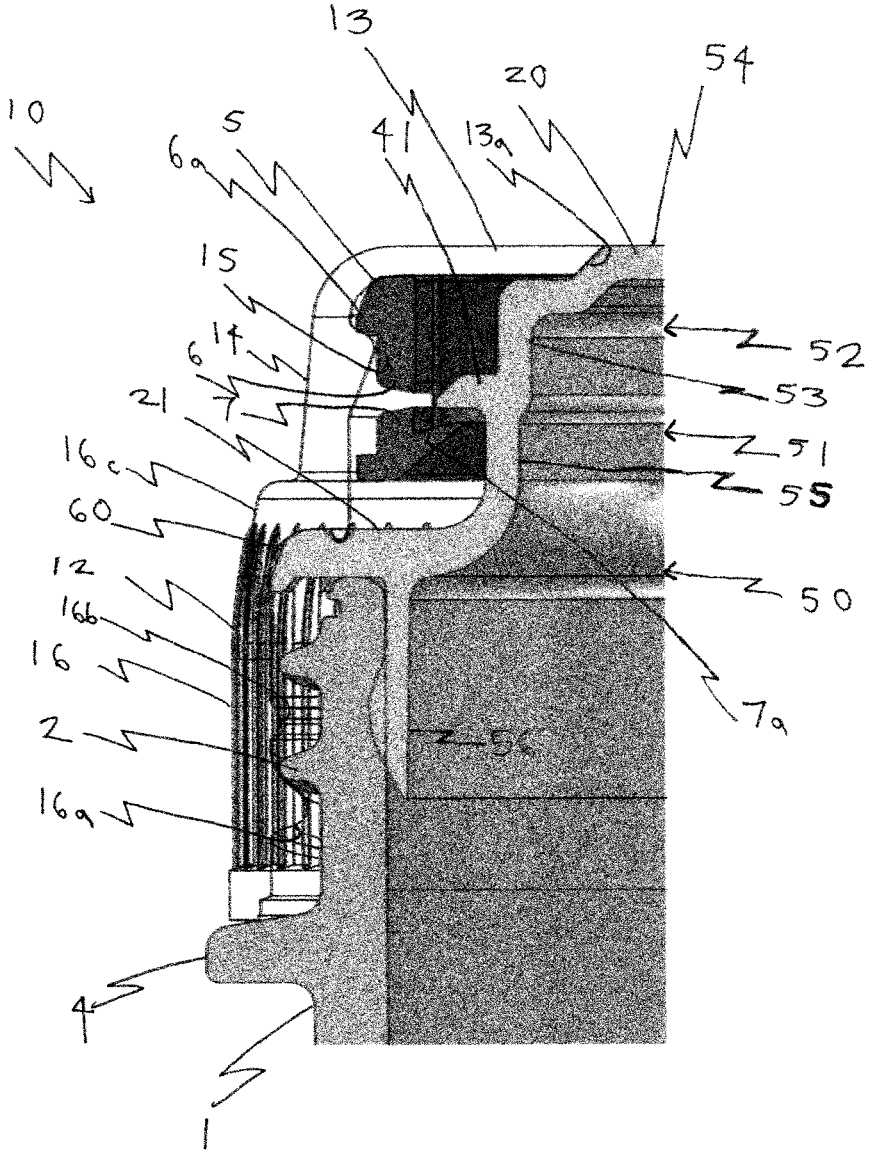
FIG. 3 is a magnified view of the closure of FIG. 2.

FIGS. 1 to 3 show a closure generally indicated 10 connected to a container neck 1.

The closure 10 comprises a body 12, a plug member 20 and a tamper-evident member 5.

The body 12 comprises a top plate 13 from which depends an upper sidewall 14.

The top plate 13 is annular and includes a central hole 13*a*.

The sidewall 14 is generally cylindrical and includes an internal annular bead 15 which projects radially inwards at a point axially displaced from the top plate.

A generally cylindrical lower sidewall 16 continues from the upper sidewall 14. The side wall 16 terminates with an annular shoulder 16*c* which extends radially inwards and merges into the upper sidewall 14.

The interior of the side wall 16 comprises internal screw thread formations 16*a* for engaging corresponding external screw thread formations 2 on the container neck located above a transfer bead 4. The interior of the side wall 16 further comprises an annular retention bead 16*b* positioned axially above the screw thread 16*a*.

The plug 20 comprises a lower portion 50, a central portion 51 and an upper portion 52.

The lower portion 50 comprises a ledge 21 with an annular seal 56 depending therefrom. In use, the seal 56 enters the bore of the container neck such that it seals against its inner surface.

The ledge 21 comprises a plurality of radially outwardly extending retention spokes 60 at is periphery. The spokes 60 abut against the shoulder 16*c*. It will be noted that the spokes 60 are spaced from the bead 16*b* and that they terminate with a "claw" 61 that allows them to grip onto the rim 3 of the container neck 1 which comprises a peripheral bead 3*a*.

The central section 51 includes an annular sidewall 55 and a flange 41 which projects radially outward from the side of the sidewall 55.

The upper portion 52 comprises a sidewall 53 closed at one end by a top cover 54. The top cover extends into the top plate hole 13*a*.

The tamper-evident member 5 takes the form of a separate element having an upper ring 6 and a lower ring 7 connected together by frangible connections 8.

The tamper-evident member 5 fits into the sidewall 14 of the body 12, radially outward of the plug 20.

The upper ring 6 includes an upper projection 6*a* which projects radially outwardly and engages under the sidewall bead 15.

The lower ring 7 includes a flange 7*a* which projects radially inwardly and in the initially closed position of the closure shown in FIGS. 1 to 3 is located under the plug flange 41.

As described below the body cannot be unscrewed without breaking the frangible connections 8 and separating the rings 6, 7.

Referring now to FIGS. 4 to 9 the closure is shown being opened for the first time and then reclosed.

Figure 4A:
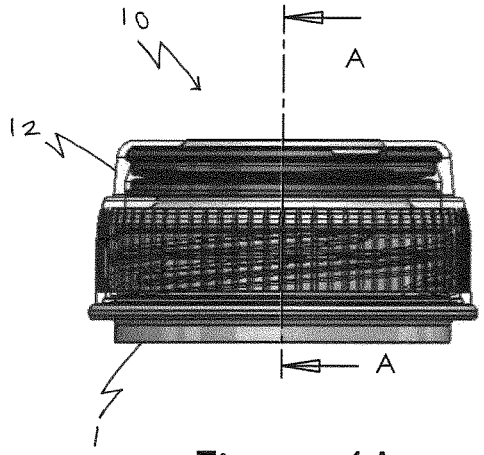
FIGS. 4 to 9 are a sequence of drawings showing a closure of the type shown in FIGS. 1 to 3 being opened and reclosed.
Figure 4B:
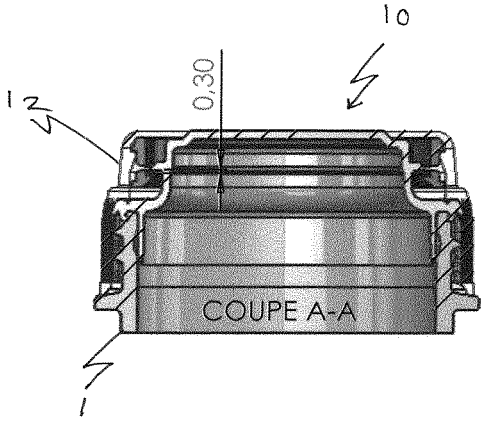

FIGS. 4A and 4B show the closure 10 in the fully closed position, as described in relation to FIGS. 1 to 3.

The closure is opened by unscrewing the body 12 from the neck 1.

Figure 5A:
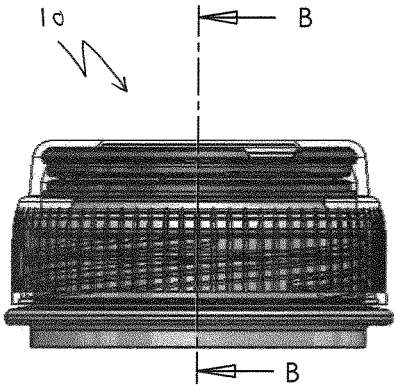
Figure 5B:
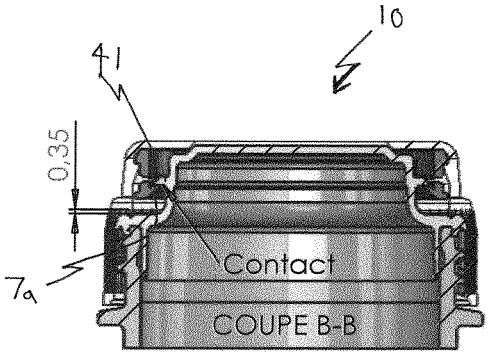
Figure 6A:
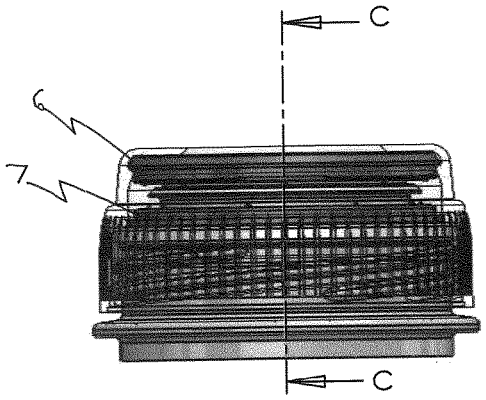
Figure 6B:
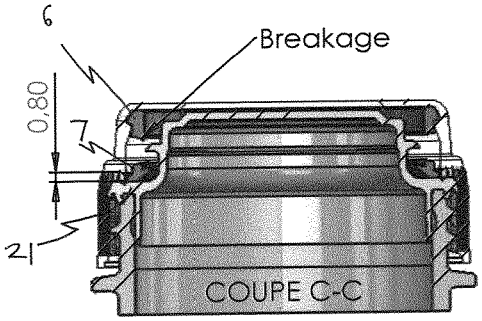

As the body is initially unscrewed it begins to move axially upwards, whilst the plug 20 remains in position. As a result the member 5 moves upwards until the ring flange 7*a* contacts the plug flange 41, as shown in FIGS. 5A and 5B Further unscrewing causes the rings 6, 7 to separate because the ring 6 is retained by the bead 15 and the ring 7 cannot pass over the flange 41. The ring 7 then drops and falls onto the plug ledge 21 as shown in FIGS. 6A and 6B.

Figure 7A:
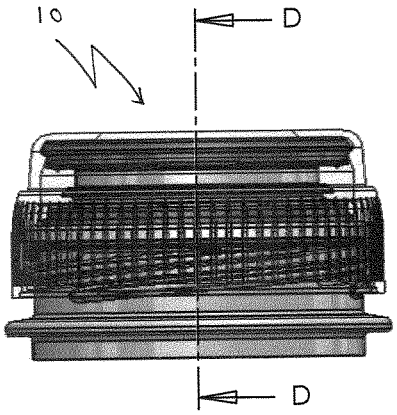
Figure 7B:
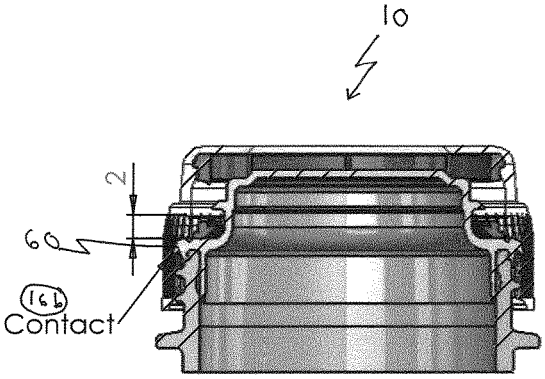
Figure 8A:
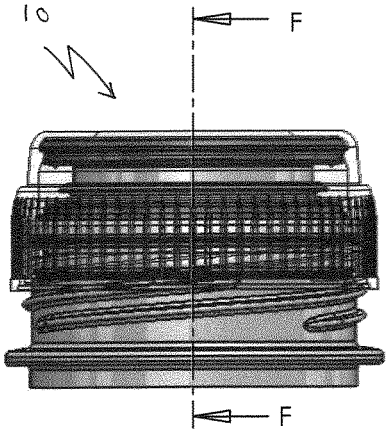
Figure 8B:
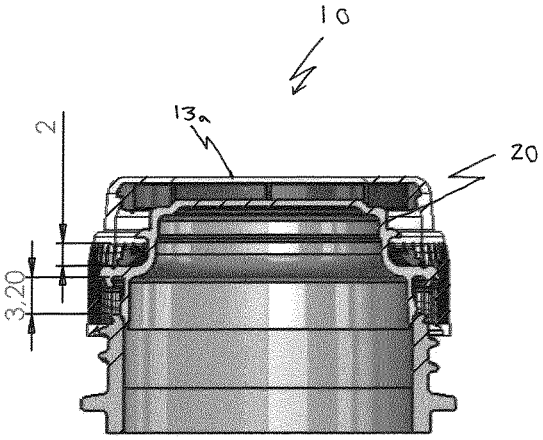

The body is unscrewed further until the sidewall retention bead 16*b* contacts the spokes 60, as shown in FIGS. 7A and 7B. Further unscrewing causes the body to lift the plug, as shown in FIGS. 8A and 8B. The closure 10 can now be removed.

Figure 9A:
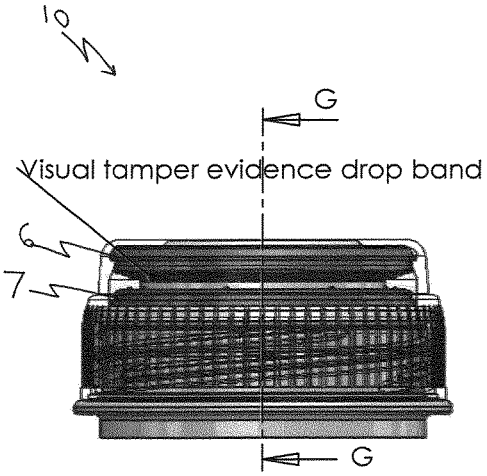
Figure 9B:
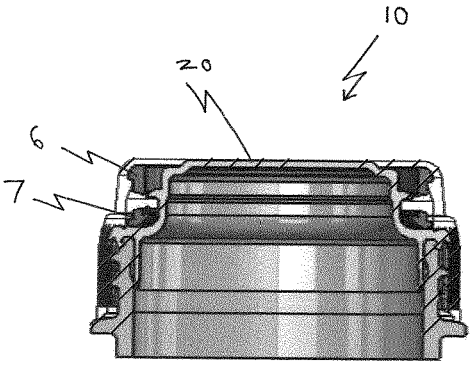

When the closure 10 is replaced and screwed back onto the neck 1 the rings 6, 7 remain separated, as shown in FIGS. 9A and 9B.

In this embodiment the body is non-opaque (for example translucent or transparent). This means that the separated rings are clearly visible. In other embodiments part of the body is non-opaque, or there is an opening/window formed in the body so that the at least one of the rings is visible/not visible in the initially unopened position and/or the reclosed position.

Figures 10A, 10B:
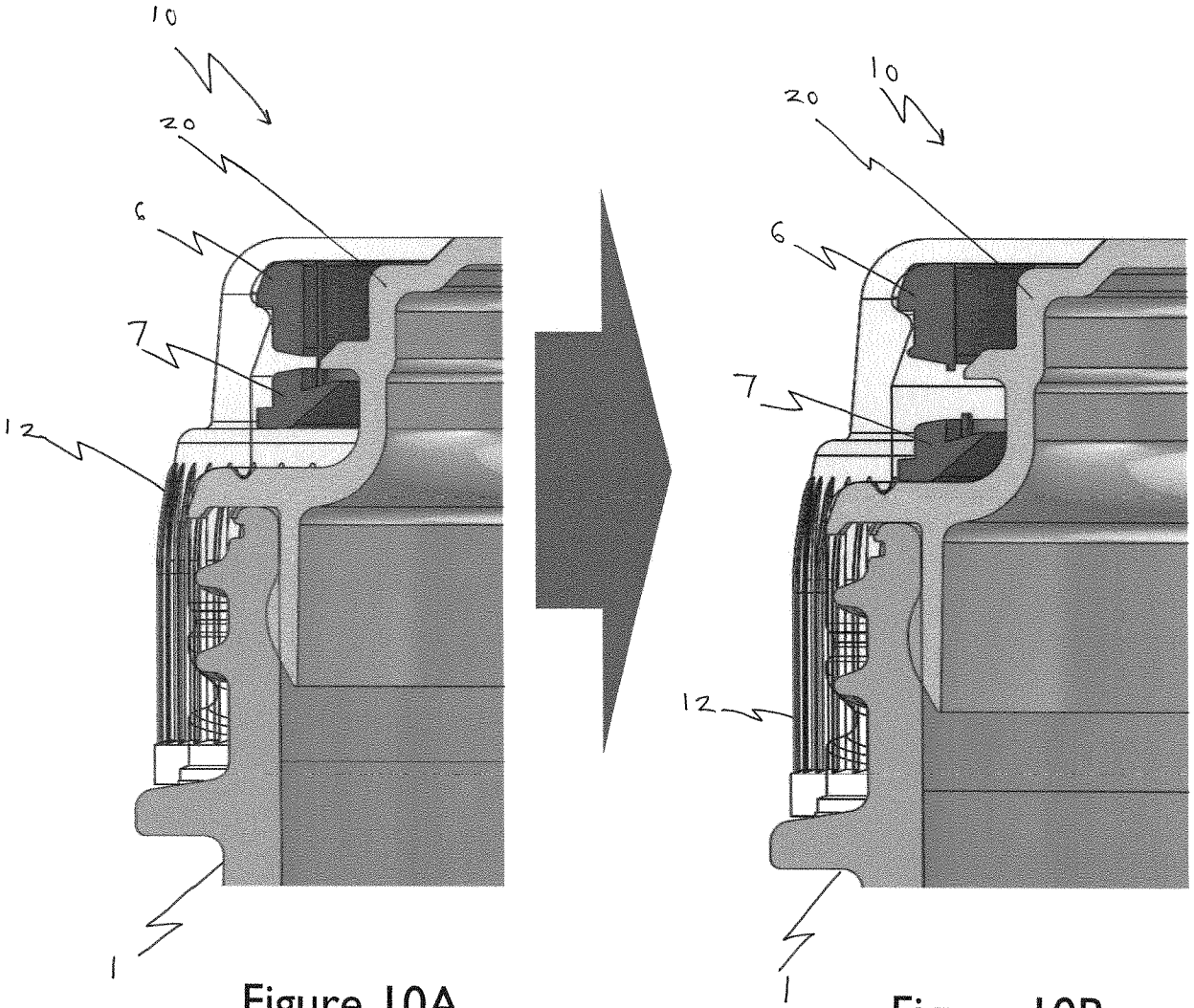
FIGS. 10A and 10B show a magnified view of the closure of FIGS. 4 and 9.

In this embodiment, therefore, the present invention provides an internal tamper-evident band for a flatcap, activated by unscrewing of the body from the neck. The closure moves from the appearance shown in FIG. 10A to the appearance shown in FIG. 10B.

In this embodiment the closure is formed without a tamper-evident drop band at the free end of the sidewall. This means that there is no requirement for a bead on the neck which would otherwise be required to engage under a drop band and cause it to be broken away from the sidewall. As a result a neck finish 101, for example, of the type shown in FIGS. 11 to 14 is possible. This allows for weight reduction of the bottle neck and the closure and avoids issues of unwanted band breakage when the closure is applied to the neck.

The neck finish 101 includes a transfer bead 104.

The finish 101 is the part of the container that holds a cap or closure in use, and surrounds the opening 103 in the container. It is so named because, in early hand glass manufacturing, it was the last part of the glass container to be made, hence the term "finish"

The exterior of the finish 101 includes a single start screw thread 105. In this embodiment this is a continuous spiral projecting ridge on the finish intended to mesh with the thread of a screw-type closure. Other screw thread formations, including multi-start threads, are possible.

The transfer bead 104 is a continuous horizontal ridge near the bottom of the finish used in transferring of a container from one part of a manufacturing operation to another.

The neck finish rim 106 includes an undercut 107.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A tamper-evident closure comprising a body and a separate plug member, the body having a sidewall including screw thread formations for screwing the closure onto a screw threaded container neck and the plug member being locatable on the neck to seal it, the closure comprising a tamper-evident member at least part of which is movable from a first position to a second position when the closure is unscrewed from the neck for the first time, in which the tamper-evident member comprises two or more parts frangibly connected together which are separated when the body is unscrewed, one of the tamper-evident member parts is retained by the body and one of the parts is retained by the plug member, in use when the body is unscrewed for the first time the body moves axially with respect to the plug member to cause the tamper-evident parts to be separated.

2. The closure as claimed in claim 1, in which the body comprises retention means for retaining the tamper-evident member part and in which the retention means comprise an annular bead.

3. The closure as claimed in claim 1, in which the tamper-evident member is located in the interior of the closure.

4. The closure as claimed in claim 1, in which the body includes a window in which or through which a part of the tamper-evident member is visible in the first position and out of which the part falls as the member moves to the second position.

5. The closure as claimed in claim 1, in which the body includes a surface formation for engaging the plug member as the body is unscrewed to lift the plug member off the neck in use.

6. The closure as claimed in claim 5, in which the formation is axially spaced from the plug member in the initially closed position so that lifting of the plug member is delayed until after the body has moved axially with respect thereto so as to cause separation of the tamper-evident member parts.

7. The closure as claimed in claim 1, in which the plug member comprises retention means for retaining it on the container neck.

8. The closure as claimed in claim 7, in which the plug member retention means is overcome by the body surface formation to lift the dispensing member off the neck.

9. The closure as claimed in claim 1, in which the tamper-evident member comprises two rings frangibly connected together.

10. The closure as claimed in claim 1, in which after first opening one of the tamper-evident member parts remains in the body and the other drops onto the plug member.

11. The closure as claimed in claim 1, in which the body comprises a top plate.

12. The closure as claimed in claim 11, in which the top plate is generally flat.

13. The closure as claimed in claim 11, in which the top plate includes a hole through which at least part of the plug extends in the fully closed position.

14. The closure as claimed in claim 1 in combination with a container.

15. A tamper-evident closure comprising a one-piece body and a separate plug member, the body having a sidewall including screw thread formations for screwing the closure onto a screw threaded container neck and the plug member being locatable on the neck to seal it, the closure comprising a tamper-evident member, the member comprising two parts frangibly connected together, one of the tamper-evident member parts is retained by the body and the other part is retained by the plug member, in use when the body is unscrewed for the first time the body moves axially with respect to the plug member to cause the tamper-evident parts to be separated.

16. A tamper-evident closure comprising a one-piece body and a separate plug member, the body having a sidewall including screw thread formations for screwing the closure onto a screw threaded container neck and the plug member being locatable on the neck to seal it, the closure comprising a tamper-evident member, in which the plug member comprises a sidewall closed at one end by a top cover, in which the tamper-evident member comprises two parts frangibly connected together, one of the tamper-evident member parts is retained by the body and the other part is retained by the plug member, and in which in use when the body is unscrewed for the first time the body moves axially with respect to the plug member to cause the tamper-evident parts to be separated.

17. A closure as claimed in claim 16, in which the body comprises a top plate.

18. A closure as claimed in claim 17, in which the top plate is generally flat.

19. A closure as claimed in claim 17, in which the top plate includes a hole into which or through which at least part of the plug extends in the fully closed position.

20. A closure as claimed in claim 19, in which the top cover of the plug member extends into the top plate hole.

* * * * *